US006753898B2

(12) United States Patent
Kubota

(10) Patent No.: US 6,753,898 B2
(45) Date of Patent: Jun. 22, 2004

(54) METHOD AND APPARATUS FOR HIGH SPEED DIGITIZED EXPOSURE

(76) Inventor: Masanori Kubota, 100 Hobson Dr., Hockessin, DE (US) 19707

( * ) Notice: Subject to any disclaimer, the term of this patent is extended or adjusted under 35 U.S.C. 154(b) by 178 days.

(21) Appl. No.: 10/051,546

(22) Filed: Jan. 18, 2002

(65) Prior Publication Data

US 2002/0140801 A1 Oct. 3, 2002

Related U.S. Application Data

(60) Provisional application No. 60/279,822, filed on Mar. 29, 2001.

(51) Int. Cl.[7] ..... B41J 2/435; B41J 2/44; B41J 2/465

(52) U.S. Cl. ..... 347/239; 347/255

(58) Field of Search ..... 347/239, 255

(56) References Cited

U.S. PATENT DOCUMENTS

| | | | |
|---|---|---|---|
| 4,375,648 A | 3/1983 | Mir | 358/75 |
| 4,560,994 A | 12/1985 | Sprague | 346/108 |
| 5,453,778 A | 9/1995 | Venkateswar et al. | 347/239 |
| 5,684,620 A | 11/1997 | Schoon | 359/298 |
| 5,754,218 A | 5/1998 | Baek et al. | 347/240 |
| 5,757,411 A | 5/1998 | Florence | 347/245 |
| 5,825,400 A | 10/1998 | Florence | 347/239 |
| 5,825,552 A | 10/1998 | Kurtz et al. | 359/629 |
| 6,025,859 A | 2/2000 | Ide et al. | 347/135 |
| 6,049,317 A | 4/2000 | Thompson et al. | 345/85 |
| 6,204,875 B1 | 3/2001 | De Loor et al. | 247/241 |
| 6,208,369 B1 | 3/2001 | Oren et al. | 347/244 |

FOREIGN PATENT DOCUMENTS

JP 4-34408 * 2/1992

* cited by examiner

*Primary Examiner*—Huan Tran
(74) *Attorney, Agent, or Firm*—RatnerPrestia

(57) ABSTRACT

A light modulation and exposure system comprising: a light source; a light sensitive media; a two-dimensional light modulator containing a plurality of rows of light valves; means of imaging light source onto light modulator and light modulator onto light sensitive material; means of generating relative motion between image of light modulator and light sensitive material; means of shifting into the first of rows the data to be imaged onto light sensitive material and means of editing data from the first row to subsequent rows of modulator at a rate keeping the image of individual data pattern substantially stationary relative to light sensitive material until data transferred to the selected final rows; this sequence continuing until all data to be imaged has passed through light modulator. The two-dimensional light modulator may be oriented at a rotation relative to the direction of motion of the light sensitive media in a manner conducive to achieving variable resolution levels and half-tone generation.

20 Claims, 5 Drawing Sheets

METHOD AND APPARATUS FOR HIGH SPEED DIGITIZED EXPOSURE

This application claims priority to U.S. Provisional Application No. 60/279,822 filed Mar. 29, 2001, the contents of which are incorporated herein by reference.

BACKGROUND OF THE INVENTION

1. Field of the Invention

The present invention relates generally to image projection, image scanning and image printing systems and more particularly to a method of controlling resolution and exposure to improve image quality using imaging array technology.

2. Background of the Invention

Light valves, such as micro-electro-mechanical systems (MEMS) and liquid crystal displays (LCD), have been used in image exposure processes to expose light sensitive media in patterns prescribed by rows and columns of the light valve modules. Typically, the desired image is defined by light valve modules activated to illuminate the light sensitive media directly. The resolution and pitch of the light valves typically determines the resolution and pitch limitations of the image.

FIG. 1, adapted from U.S. Pat. No. 4,560,994 issued to Sprague, shows typical optics configurations for scanning imaging information onto an external drum device 20. A light source 10 is used to project an image. Optics 12, 16, 24 and a light modulator 14, are required to produce an image.

The general configuration of a light valve array 14 is shown in FIG. 1. The array is organized in columns and rows of individual light valves, with a space or gap between the light valves. The columns and rows are in a straight line and have the same pitch throughout the array. The pitch of an array is its light valve size plus the gap size. The pitch is defined herein as the distance from center to center of adjacent light valves.

This type of array requires a gap between light valves on the grid to minimize cross talk and avoid mechanical defects. The size of the gap between light valves has a direct impact on the image quality for projected, scanned and printed images. Large gaps reduce the quality of projected images and reduce the resolution of the printed image.

Efforts have been made to increase resolution by reducing the light valve dimensions and light valve gap. The resulting small light valves with small gaps pass lower levels of transmitted or reflected light, thus reducing the brightness level of the projected image and the amount of light energy reaching the photosensitive media.

One method and apparatus for exposure control of images formed by two dimensional light valve arrays is described by Gelbart in U.S. Pat. No. 5,132,723. The '723 patent describes a method and apparatus for exposure control in which the intensity variation between rows of light valves due to defective light valve modules is compensated for by deliberately deactivating non-defective light valves. In this method, a depression in the light intensity profile caused by a defective light valve is adjusted by deliberately inhibiting or turning off functional light valves in other rows. As a result, the intensity profile is uniformly depressed across the light valve rows when a single light valve is defective.

Another method and apparatus for exposure control of images formed by two dimensional light valve arrays is described by Gelbart in U.S. Pat. No. 5,049,901. The '901 patent describes a method in which large area light sources are used with deformable mirror devices to illuminate light sensitive material. This method employs a driver circuit and position transducer to scan light sensitive media relative to an array of light valves that are illuminated by a large area light source. By focusing the reflected light from the activated light modules, image resolution is provided with the desired intensity and energies afforded with large area light sources.

Many industrial applications require an imaging device to be capable of multiple resolution output. Current light valve technology is not able to meet this requirement without costly optical realignment. Changing the resolution available with a light valve currently requires the expensive variable optics and time consuming adjustments in the projector, imager, or detector.

There remains a need for electronic control of resolution and exposure using a light valve modulator without the use of expensive variable optics in a variety of applications, including image projection, detection and printing. Furthermore, there remains a need in the art to obtain high resolution using a light valve modulator.

SUMMARY OF THE INVENTION

The present invention provides an imaging system that comprises a surface for receiving an image, and a light modulator. The light modulator comprises a plurality of light valves in a two-dimensional array that has orthogonal rows and columns in a Cartesian coordinate system with first and second orthogonal axes. The columns are arrayed along the first axis in the coordinate system and the rows are arrayed along the second axis. A certain number of rows in the modulator form a segment. In the imaging system, the surface is transported relative to the modulator in a direction along a transport axis. The first axis and the transport axis form an angle $\alpha$ other than 90°, this angle $\alpha$ is inversely proportional to the number of rows in each segment. The number of rows in the segment is n, and n is an integer that is greater than 1. The modulator has at least 2 segments, and each light valve has an X dimension along the first axis and a Y dimension along the second axis. The light valve dimensions are equal, X=Y, and the angle $\alpha=\tan^{-1}(1/n)$.

DESCRIPTION OF THE PREFERRED EMBODIMENT(S)

The invention will next be illustrated with reference to the figures wherein similar numbers indicate the same elements in all figures. Such figures are intended to be illustrative rather than limiting and are included herewith to facilitate the explanation of the apparatus of the present invention.

Figure 1:
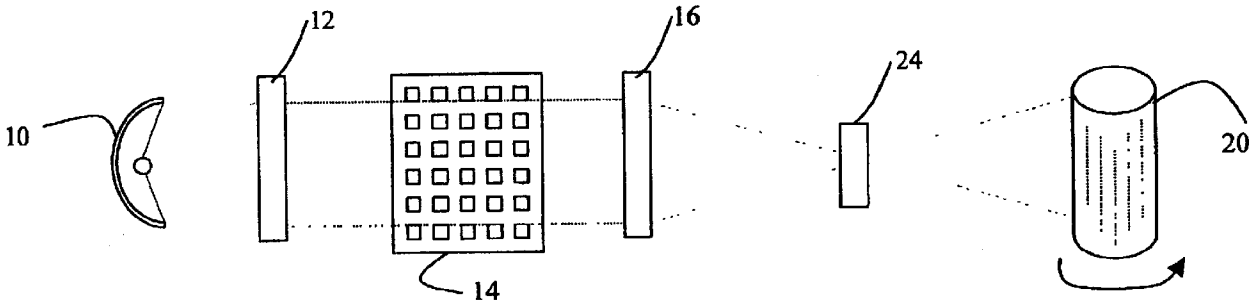
FIG. 1 PRIOR ART
FIG. 1 schematically illustrates a typical configuration for light valve imaging onto a cylindrical drum.
Figure 2:
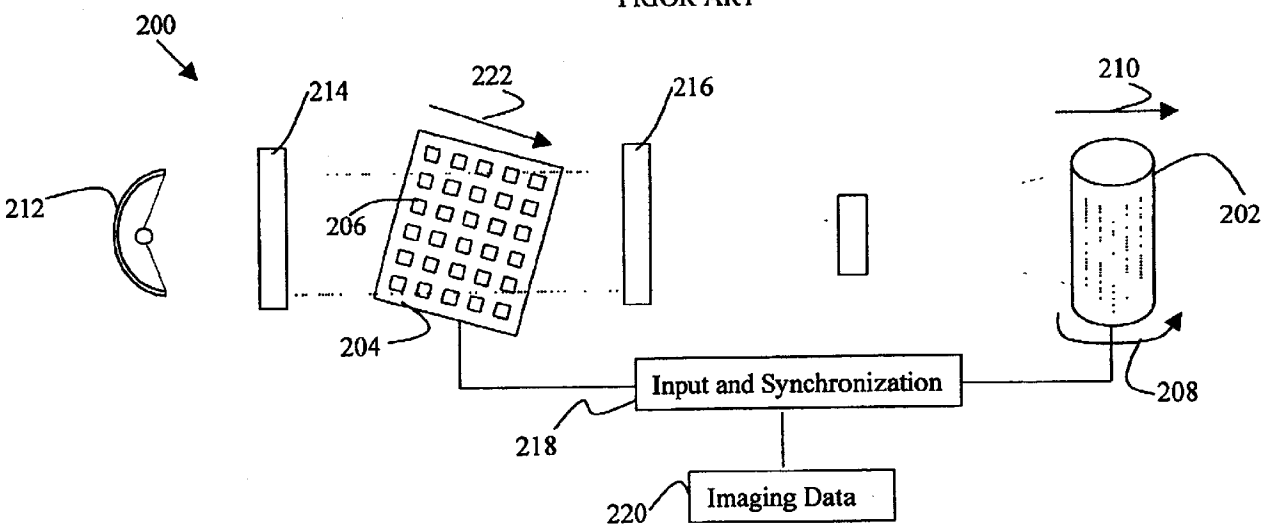
FIG. 2 schematically illustrates a configuration for light valve imaging onto a cylindrical drum according to the present invention.

One embodiment of the present invention is schematically illustrated in FIG. 2 and includes an imaging system 200 comprising a surface for receiving an image 202, and a light modulator 204 comprising a plurality of light valves 206 in a two-dimensional array having orthogonal rows and columns. The rows and columns of the array are aligned in a Cartesian coordinate system with two orthogonal axes. For description purposes herein the array columns are described as being aligned on the first axis and the array rows are described as being aligned along the second axis in this Cartesian coordinate system.

As shown in FIG. 2, a radiant energy source 212 and a lens 214 direct light onto the light modulator, and another lens 216 directs the radiation onto the surface 202. The surface 202 is any photosensitive surface, such as a printing plate. The surface may also be an image detecting element, such as a photosensitive layer, a circuit board, a radiation detection device or an array of photosensitive elements.

Figure 3:
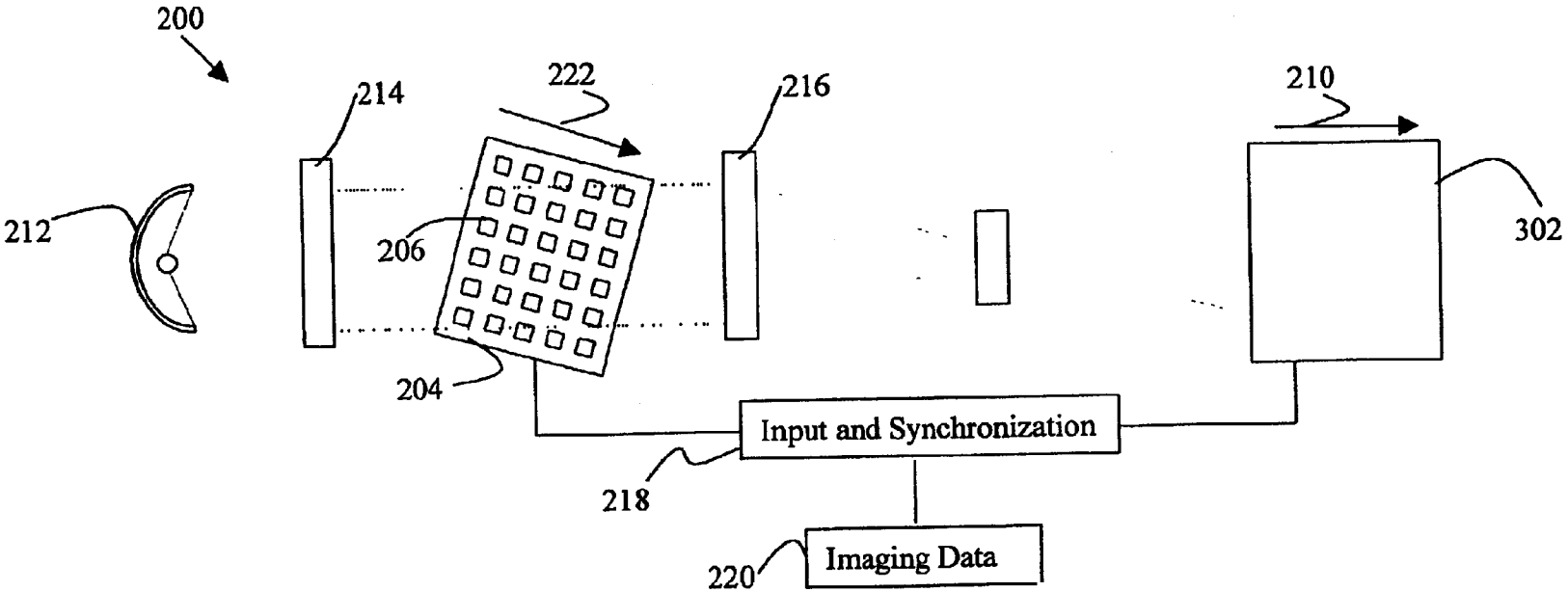
FIG. 3 schematically illustrates a configuration for light valve imaging onto a flatbed drum according to the present invention.

As shown in FIG. 2, the surface is wrapped around a cylinder and transported in a circular manner 208, which effectively moves the surface in a direction along a transport axis 210. The transport axis and the array columns (along the first axis) form an angle. In addition to the configuration shown in FIG. 2, a transport head can be used to transport the light valve array around the imaging surface on a cylindrical drum. An alternate embodiment of the present invention is shown in FIG. 3, which illustrates a flatbed imaging surface 302, that is similarly transported in the transport direction 210.

The light source may be any of a variety of light sources. For projection, a white light source with radiation in the visible 400 nm to 700 nm range is typically selected. For printing, the energy source is dependent on the photosensitivity of the media and can be ultraviolet, visible light or infrared light. The light source may be a continuous radiant source or a coherent laser source.

The light modulator 204 may be one of any number of light modulators that are commercially available, including: optical switches, MEMS devices, electro-holographic devices, acousto-optic devices, liquid crystal display devices, Bragg grating devices, bubblejet devices, thermo-optic interferrametric devices and thermo capillary devices. Deformable mirror devices (DMD) introduced by Texas Instruments, are a preferred type of light modulator used in these applications.

The imaging system may also include an optical projection system for directing at least a portion of the radiation onto the modulator and then onto the surface. Such an optical projection system may comprise magnifying optics, and electronic controls. The system may also include means for scanning that scan the radiation on the surface.

A means for controlling the input of the imaging data 218, typically pixel data is connected to the light modulator 204. The input means is also connected to a transporter that transports the surface in the transport direction, and synchronizes the transport and activation of the light modulators according to the image data 220. This means for input of the imaging data 218 may be a modulator controller that is connected to the light modulator and turns any selected number of light valves in the light valve array on and off. The controller may also synchronize the transporter and the modulator controller to repeatedly expose a same selected area on the surface using light valves in different light valve rows to effect cumulative exposure of the desired surface area.

The light modulator 204, is shown as a two-dimensional array of light valves 206 in FIGS. 2 and 3 which is positioned such that the axis 222 that the columns are aligned along, forms an angle with the transport direction 210. The relationship between image exposure and this angle is described in more detail in reference to FIGS. 4 and 5.

Figure 5:
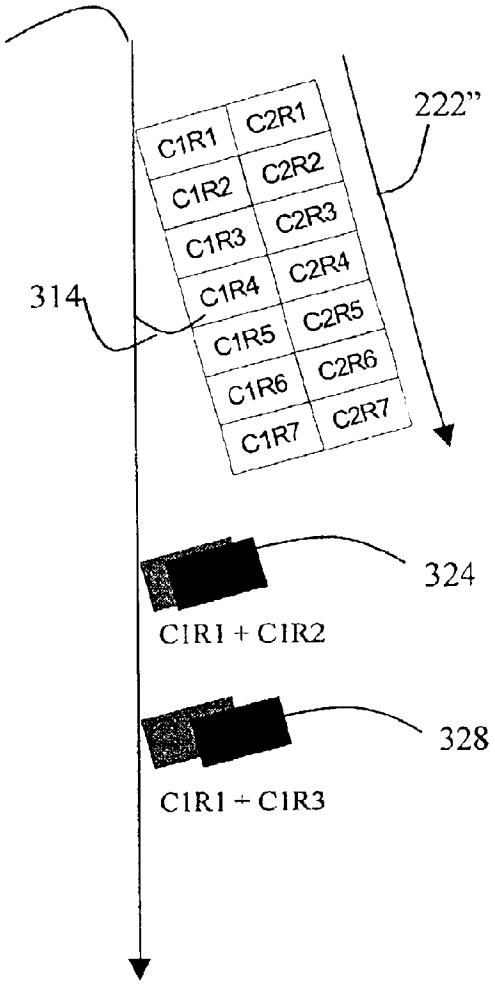
FIG. 5 schematically illustrates imaging at a large angle $\alpha$ according to the present invention.
Figure 4:
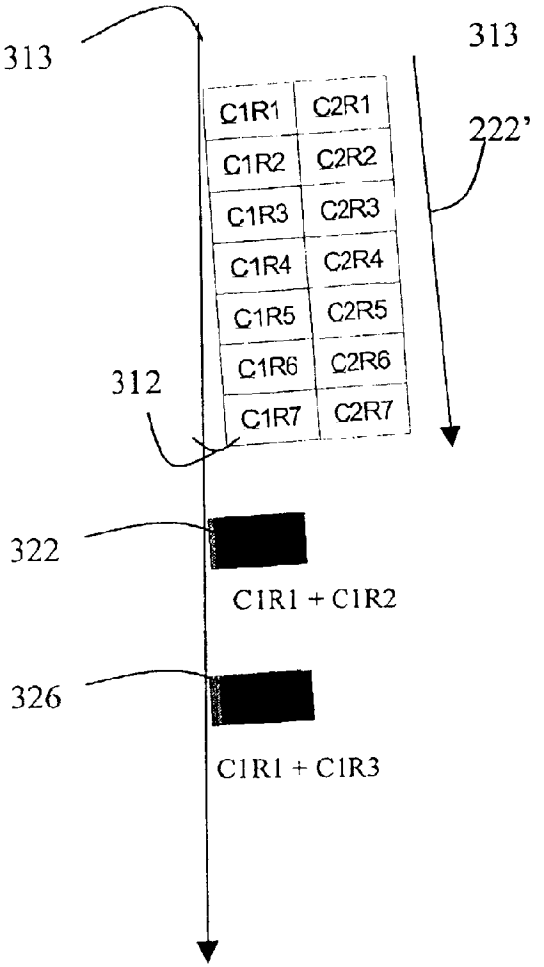
FIG. 4 schematically illustrates imaging at a small angle $\alpha$ according to the present invention.

The exposure spot size 322 from two adjacent light valves (C1R1 and C1R2) in the same light valve array column oriented at a small angle 312 to the transport direction 313 is shown in FIG. 4. The exposure spot size 324 generated from the same light valves in an array oriented at a larger angle 314 is shown in FIG. 5. As shown in FIGS. 4 and 5, each light valve is labeled according to the column (C) number and row (R) number. Because the orientation angle may be small (312), the difference in the width of exposure between a single light valve (C1R1) and two light valves (C1R1+C1R2) 322 may also be very small, as the small rotation angle provides significant overlap between light valves in the same column.

As the rotation of the light valve array is increased, as shown in 5, the angle 314 between the transport direction 313 and the column axis 222" is larger. With a larger rotation angle, there is less spatial overlap between light valves in the same column, thus forming a larger exposure area with less overlap 324 using the same two activated light valves, C1R1+C1R2.

The light source, modulator and surface may be selected so that illumination from a single light valve satisfies the exposure threshold of the photosensitive surface. Under these circumstances, multiple light valves can be combined to provide a variety of exposure sizes, and the exposure size is not restricted to incremental multiples of the light valve dimensions.

Alternatively, the light source, modulator and photosensitive surface may be combined such that illumination from a single light valve does not satisfy the exposure threshold of the photosensitive surface. In this arrangement, exposure from multiple light valves would be required to expose the surface, and in an exposing configuration such as 324 in FIG. 5, the exposure threshold of surface would be satisfied only in the overlapping region of the light valves C1R1 and C1R2, shown darkened. Exposed areas with dimensions much smaller than the light valve dimensions could be achieved using this arrangement.

Variable resolution can be easily achieved by the present invention in activating different light valves in the column segment. For example, utilizing a combination of C1R1 and C1R2 in the array orientation shown in FIG. 4 provides an image resolution of 15,000 dpi 322 on a single light valve exposure medium. Using a combination of C1R1 and C1R3 in the same array provides an image resolution of 7,500 dpi as the exposure area is larger 326.

Similar resolution control is achieved through adjusting the overlap region of light valves when multiple light valve exposure is required to meet the exposure threshold of the photosenstive surface, as illustrated in FIG. 5. The resolution may be controled digitally by the activation of various rows. The combination of light valves C1R1+C1R3 forms an illumination area 328 that has a smaller overlapping region than does the illumination area 324 formed by the combination of C1R1+C1R2.

By orienting a light valve array such that the columns (or rows) are at an angle to the imaging media transport direction, the pitch of the light valve array with the same dimensions is reduced. In one embodiment of the present invention, the orientation of the light valve array to the imaging surface may vary, and is adjusted to provide the desired pitch and resolution as specified by the imaging application requirements. In an alternate embodiment, the light valve device is manufactured with a predetermined angle built into the array. The pre-determined angle would be consistent with the array light valve size, and desired resolution and pitch parameters. One exemplary light valve device with 16 $\mu$m×16 $\mu$m light valve dimensions has a light valve array oriented at a 6° rotation from the scanning direction of the imaging media.

Figure 6:
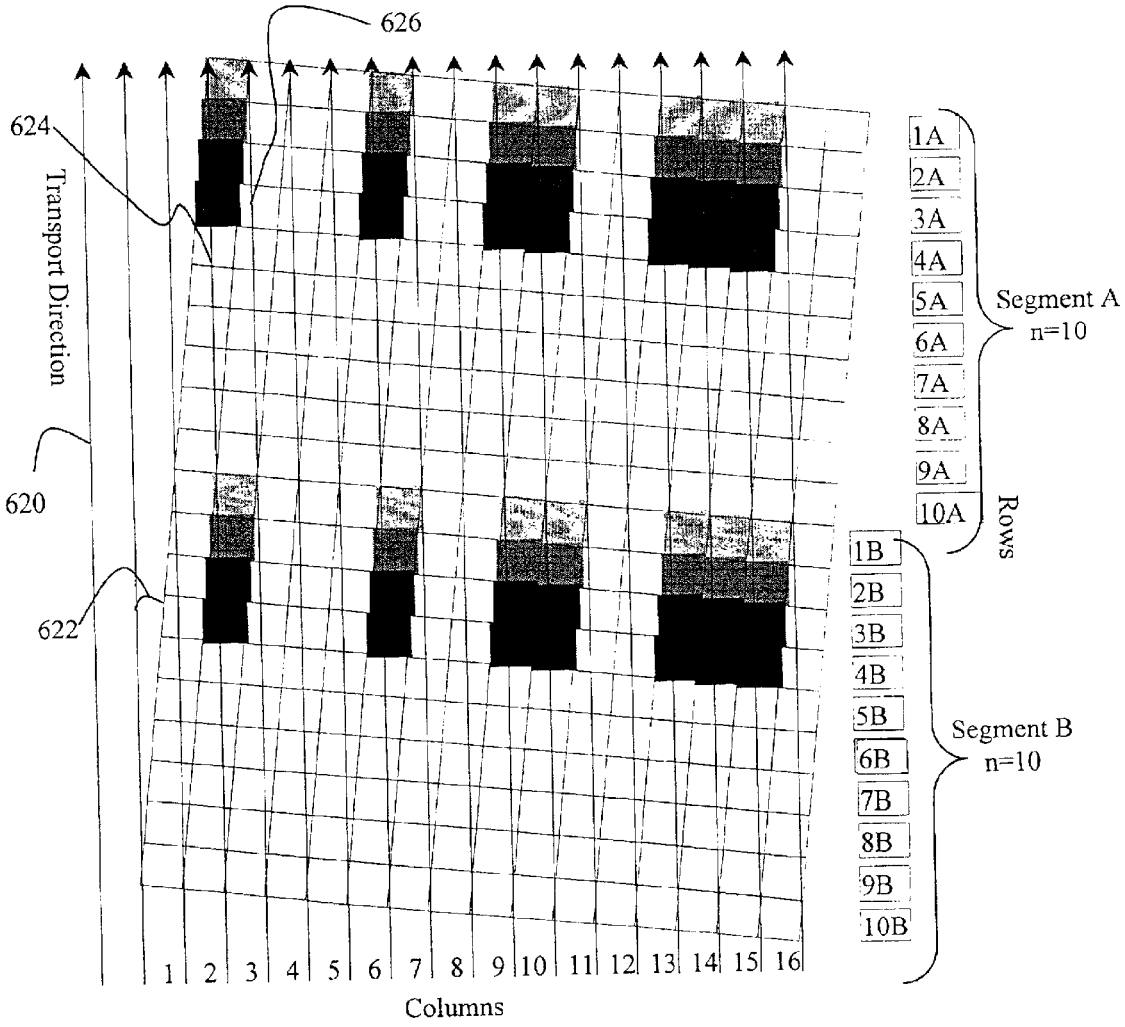
FIG. 6 schematically illustrates a light valve array of the present invention.

The angle of the column axis of the array to the transport direction is preferably correlated to the number of rows dedicated to produce a single exposure spot in optimizing the desired exposure. In this correlation, a plurality of light valve rows combine to form an image segment. The two dimensional light valve array shown in FIG. 6 illustrates the division of rows into image segments. The resolution of an image correlates to the number of rows dedicated to the image segment, with more rows providing greater resolution flexibility for a given array.

The angle 622 (referred to generically as $\alpha$ herein) of array rotation away from the transport direction axis 620, can be described through the number of rows in a segment. As shown in FIG. 6, there are 10 rows of light valves in a segment. Rows are labeled 1A through 10A in segment A and similarly labeled 1B through 10B for segment B. The rows are assigned to segments in this embodiment of the present invention according to the constraint that a light valve in one segment aligns with the like numbered row of the next segment in an adjacent column. For example, a light valve in row 1A (first row of segment A), and in column 1 lies between two axis that are parallel to the transport direction 624 and 626. The light valve 1B (first row of segment B) in column 2 also lies between the two axes 624 and 626. Thus, these light valves overlap along the transport direction axis, despite being in adjacent columns.

The angle, $\alpha$, is inversely proportional to the number of rows used in a segment, and is typically an angle other than 90°. The array, as shown in FIG. 6, is organized such that there are a discrete, whole number of rows that form a segment. The number of rows in the segment, referred to herein as n, is an integer greater than 1, and the modulator array comprises at least 2 segments of n rows. The value of n has an inverse relation to the magnitude of the rotation angle, and represents the number of rows of light valves necessary to translate a column in the width of one light valve.

As shown in FIG. 6, the light valves are square, and each light valve has an X dimension along one axis and a Y dimension along an orthogonal axis, and X=Y. The angle $\alpha=\tan^{-1}(1/n)$ and is preferably between about 2° and 45°.

The present invention provides a method for controlling resolution using a light valve array. The method of the present invention includes aligning the light valve array so that a column of light valves in the array forms an angle with a scanning direction of the imaging, projection or detection surface. The angle is adjusted to correspond to a desired image resolution, and light valve rows are apportioned into an image segment accordingly. The light valves can then be digitally controlled within the image segment to achieve the desired image resolution. The image segment is repeated until the integrated exposure generated by the image segment satisfies the exposure threshold for the imaging surface or other application.

A precession of image segments consistent with the present invention is schematically illustrated by an exemplary light valve array in FIG. 6. The rows of the array are labeled 1A–10A and 1B–10B, and the columns are labeled 1–16. In the array illustrated in FIG. 6, there are 10 rows of light valves in each image segment. For an array with 17 $\mu$m pitch light valves, an angle of 6° to the scanning direction establishes an array orientation such that 10 rows provide translation equal to the width of one column or light valve. In the array illustrated in FIG. 6, there are four rows of the first segment that contain activated light valves. The activated light valves of the first segment are in seven columns, columns 1, 5, 8, 9, 12, 13, and 14, and define the projected image for the first image segment.

The second segment of rows (rows 1B–10B), have a similar image pattern, but the illuminated light valves have shifted by one column, so that the illuminated light valves are in columns 2, 6, 9, 10, 13, 14, and 15. The column shift compensates for the angle of orientation and the timing of light valve activation is synchronized to the scanning transport speed of the imaging surface.

An image segment may include at least one row, and as many rows as necessary. Preferably, the number of rows in a segment is determined by the sensitivity of the media, and the intensity of the light source. The number of rows per segment can be selected such that the rows of each segment combine to adjoin with the adjacent column. In the example shown in FIG. 6, a segment of 10, 16 $\mu$m square light valves, with 1 $\mu$m between light valves, at an angle of 6° from the scanning direction allows exposure from adjacent columns to adjoin when all ten rows of the segment are activated.

The present invention provides a method for controlling photo exposure with a light valve array by aligning the light valve array so that a column of light valves forms an angle with the transport direction axis. The light valve rows are apportioned within the column into an image segment, the light valves are digitally controlled to repeat the image segment until the integrated exposure satisfies the exposure threshold for the application.

Figure 7:
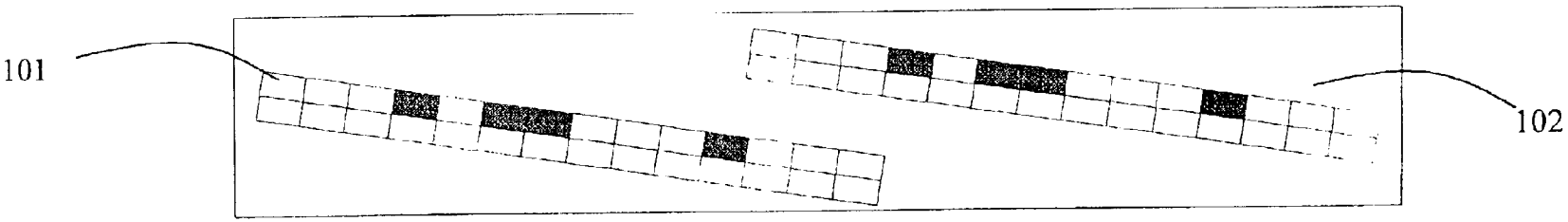
FIG. 7 schematically illustrates a mechanism of multiple array alignment according to the present invention.

The present invention further facilitates alignment of multiple light valve arrays. FIG. 7 shows a mechanism for multiple array alignment. One method for alignment of multiple arrays is by the use of overlap exposure of the arrays. This procedure is taught in U.S. Pat. No. 5,757,411. The technique described in the '411 patent requires a very fine level of position control for the alignment of the arrays. FIG. 7 illustrates the use of a rotated array technique in the alignment of multiple arrays 101 and 102. These rotated arrays do not require precise directional mechanical alignment as directional alignment can be done digitally. For example, a 17 $\mu$m light valve pitch array at a 6° angle to the transport direction axis provides a 1.7 $\mu$m pitch scan accuracy between rows. The directional alignment can be measured on the output media and tuned digitally using calibration software.

The present invention provides for varying the resolution of halftone reproduction using light valves with fixed dimensions without using optical or mechanical movement. The light valves provide rapid exposure times for imaging applications. By rotating the light valve array, the present invention also provides increased resolution previously requiring either smaller light valve dimensions, expensive optics or laser beam technology.

This technology has been illustrated in the figures for convenience and consistency as it applies to exposure devices. These exposure devices may be used in a number of applications including, but are not limited to: printing plates, including offset, flexography; printed circuit boards; plasma displays; medical imageries and medical treatment devices. The invention is applicable to other imaging and projection devices, as well as radiation detection devices. Projection applications can include optical switches to provide movie projectors and slide projectors with higher resolution and exposure control. The same practices are employed in these applications as illustrated in the figures. Detection devices may also utilize the present invention. For example, radiation detection arrays and image sensors can be configured in arrays and oriented such that the resolution of the detection devices are enhanced according to the present invention. These detection devices include, but are not limited to; CIS, CMOS, CCD and FEIS devices. Detection of any type may be enhanced by the present invention including microscopes, telescopes, digital cameras and scanners, as well as medical imaging devices and analytical spectrometers.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

I claim:

1. An imaging system comprising a surface for receiving an image, and a light modulator comprising a plurality of light valves in a two-dimensional array having orthogonal rows and columns in a first Cartesian coordinate system having a first and a second orthogonal axes, said columns arrayed along said first axis in the coordinate system; said rows arrayed along the second axis and a number of said rows forming a segment; and wherein said surface is transported relative to the modulator in a direction along a transport axis; wherein the first axis and the transport axis farm an angle other than 90°, said angle $\alpha$ inversely proportional to the number of rows in the segment;

wherein the number of rows in the segment is n; n is an integer greater than 1; and the modulator comprises at least 2 segments; further wherein each light valve has an X dimension along the first axis and a Y dimension along the second axis, and X=Y and the angle $\alpha=\tan^{-1}(1/n)$.

2. The imaging system according to claim 1 wherein said angle is between about 2° and 45°.

3. The imaging system according to claim 1 further comprising a radiant energy source and at least one lens for directing said radiant energy onto said modulator.

4. The imaging system according to claim 1 further comprising at least one lens for directing said radiant energy onto said surface.

5. The imaging system according to claim 1 wherein said surface comprises a printing plate.

6. The imaging system according to claim 1 wherein said surface comprises an image detecting element.

7. The imaging system according to claim 6 wherein said image detecting element is a photosensitive layer.

8. The imaging system according to claim 1 wherein said image detecting element is a plurality of photosensitive elements.

9. The imaging system according to claim 1 wherein said imaging surface is an image display surface.

10. The imaging system according to claim 1 further comprising a modulator controller connected to said modulator for turning on and off any selected number of light valves in said light valve array.

11. The imaging system according to claim 10 further comprising a transporter for transporting said surface in a plane defined by said first coordinate system in the transport direction.

12. The imaging system according to claim 11 further including means for synchronizing said surface transporter and said modulator controller to repeatedly expose a same selected area on said surface using light valves in different light valve rows thereby to effect cumulative exposure of a desired surface area.

13. The imaging system of claim 1 wherein the surface for receiving an image is wrapped around a cylindrical drum which rotates in the transport direction.

14. The imaging system of claim 1 wherein the surface for receiving an image is positioned on a flatbed.

15. The imaging system of claim 1 further comprising a transport head that transports the light valve array, and wherein the imaging surface is a cylindrical drum and the transport head rotates around the cylindrical drum in the transport direction.

16. The imaging system according to claim 1 further comprising:

(a) a source of radiation and an optical projection system for directing at least a portion of said radiation onto said modulator and therefrom onto said surface; and (b) a scanning means for scanning said radiation on said surface.

17. The imaging system or claim 1 wherein the light modulator is selected from the group consisting of an optical switch, a MEMS device, on electro-holographic device, an acousto-optic device, a liquid crystal display device, a Bragg grating device, a bubblejet device, a thermo-optic interferrametric device and a thermo capillary device.

18. The imaging system at claim 1 wherein the surface for receiving an image is selected from the group consisting of a photosensitive surface, a display screen, a circuit board, and a radiation detection device.

19. A method of imaging comprising adjusting the light vales of the imaging system of claim 1 to provide radiation below the exposure threshold of the image receiving surface.

20. A method of imaging comprising:

(A) positioning a surface for receiving an image at a focal point of a light modulator;

said light modulator comprising a plurality of light valves in a two-dimensional array having orthogonal rows and columns in a first Cartesian coordinate system having a first and a second orthogonal axes, said columns arrayed along said first axis in the coordinate system; said rows arrayed along the second axis;

(B) forming a segment comprising a number of said rows;

(C) activating said light valves;

(D) transporting said surface relative to the modulator in a direction along a transport axis, wherein the first axis and the transport axis form an angle $\alpha$ other than 90°, said angle $\alpha$ inversely proportional to the number of rows in the segment;

wherein the number of rows in the segment is n; n is an integer greater than 1; and the modulator comprises at least 2 segments;

further wherein each light valve has an X dimension along the first axis and a Y dimension along the second axis, and X=Y and the angle $\alpha=\tan^{-1}(1/n)$.

* * * * *

UNITED STATES PATENT AND TRADEMARK OFFICE

CERTIFICATE OF CORRECTION

PATENT NO. : 6,753,898 B2
DATED : June 22, 2004
INVENTOR(S) : Masanori Kubota

It is certified that error appears in the above-identified patent and that said Letters Patent is hereby corrected as shown below:

Column 7,
Line 35, “farm” should read -- form --

Column 8,
Line 28, “or” should read -- of --
Line 30, “on” should read -- an --
Line 34, “at” should read -- of --
Line 39, “vales” should read -- valves --

Signed and Sealed this

Seventh Day of December, 2004

JON W. DUDAS
*Director of the United States Patent and Trademark Office*